US006370884B1

(12) United States Patent
Kelada

(10) Patent No.: US 6,370,884 B1
(45) Date of Patent: Apr. 16, 2002

(54) THERMOELECTRIC FLUID COOLING CARTRIDGE

(76) Inventor: Maher I. Kelada, 1301 Edgewater, Friendswood, TX (US) 77546

( * ) Notice: Subject to any disclaimer, the term of this patent is extended or adjusted under 35 U.S.C. 154(b) by 0 days.

(21) Appl. No.: 09/821,257

(22) Filed: Mar. 30, 2001

(51) Int. Cl.[7] ..... F25B 21/02
(52) U.S. Cl. ..... 62/3.64; 62/3.3; 62/389
(58) Field of Search ..... 62/3.64, 3.3, 389

(56) References Cited

U.S. PATENT DOCUMENTS 4,450,987 A * 5/1984 Boettcher et al. ..... 222/641
5,285,718 A * 2/1994 Webster et al. ..... 99/290
5,513,496 A * 5/1996 Stokes ..... 62/3.64
5,634,343 A * 6/1997 Baker, III ..... 62/3.64
5,992,685 A * 11/1999 Credle, Jr. ..... 222/1
6,080,313 A * 6/2000 Kelada ..... 210/631
6,099,735 A * 8/2000 Kelada ..... 210/652
6,105,659 A * 8/2000 Pocol et al. ..... 165/10
6,186,361 B1 * 2/2001 Teetsel, III ..... 222/1
6,197,189 B1 * 3/2001 Schwartz et al. ..... 210/192

* cited by examiner

*Primary Examiner*—William Doerrler
*Assistant Examiner*—Mark Shulman
(74) *Attorney, Agent, or Firm*—Russell J. Egan

(57) ABSTRACT

A single ended filly encapsulated water cooling cartridge for thermoelectrically cooling fluids has a vertically mounted cylindrical water flow pipe with a plurality of flat sides and acting as a cold plate communicating with an inlet of the water cooling cartridge, a like plurality of heat sinks circumferentiary positioned around the water flow pipe with longitudinal fins extending radially outwardly from each heat sink, a cylindrical shell enveloping the heat sinks and the water flow pipe and forming an annulus air passageway therein, an axial forced air fan mounted on the top of the water cooling cartridge to induce air flow along the heat sinks, thermoelectric elements acting as heat pumps positioned between the heat sink and the water flow pipe, and a temperature control thermostat.

22 Claims, 10 Drawing Sheets

THERMOELECTRIC FLUID COOLING CARTRIDGE

BACKGROUND OF THE INVENTION

1. The Field of the Invention

The present invention relates to an apparatus for cooling fluids. More particularly, the present invention relates to an in-line thermoelectrically operated water-cooling device formed as a single-ended cylindrical cartridge vertically mounted on a flowboard.

2. The Prior Art

The present invention pertains to methods and systems for water conditioning, treatment and purification and, in particular, to domestic units which are readily adaptable to treat local water in accordance with any existing long term or varying temporary condition to produce water of high purity and to a flowboard for controlling fluid distribution in the system.

Impurities in natural raw waters (surface or well water) occur in four basic different forms, namely non-ionic and undissolved impurities; ionic and dissolved impurities; gaseous impurities; and biological impurities. Each of these impurities requires separate treatment techniques and equipment for their removal.

Non-ionic and undissolved impurities include, but are not Limited to, turbidity, silt, mud, suspended solids, organic matter, bacteria, oil colloidal matter and colloidal silica.

Ionic and dissolved impurities include: a wide variety of salts dissolved in water and dissociated to form positive ions, called cations, and negative ions, called anions. The major cations in natural raw water are calcium, magnesium sodium, potassium, ammonium, iron and manganese. The major anions are carbonate, bicarbonate, hydroxide, chloride, sulfate, nitrate, phosphate, and silica.

Gaseous impurities include a number of gases that are soluble in water. Some are found naturally in well water, such as carbon dioxide, hydrogen sulfide, and methane. Others are the result of water purification or industrial application and include such gases as ammonia, oxygen and chlorine.

Biological impurities include all types of microorganisms, bacteria, viruses, and pyrogen.

In most cases, all of these four forms of impurities coexist simultaneously and in differing amounts and their relative proportions can vary, even seasonally. No single treatment or technique is adequate for or capable of removing all impurities in one step. Multiple related or interdependent processes are normally required to rid water from such impurities. Generally these processes must be constantly monitored to assure each form of impurity is being properly treated and removed.

The inventor of the subject invention is also the inventor of U.S. Pat. Nos. 6,080,313 and 6,099,735, the disclosures of which are incorporated herein by way of reference. These patents describe counter-top modular water purification and disinfection systems to remove water impurities and produce water of high quality and purity as presented in the forgoing introduction. All water treatment and control modules are single ended, bottle-like cartridges of different functions mounted on a uniquely designed flow circuit forming a base, which was named "flowboard." The subject invention discloses the use of a water cooler in the form of a bottle-like cartridge to be mounted on a flowboard of a stand-alone water-cooling apparatus or as a cooling module in a water purification system of the type described in the aforementioned patents. The flowboard is a flat box-like assembly concealing a fluid conduit extending between an inlet and an outlet and a plurality of mounting receptacles connected to the conduit, each receptacle receiving a single ended cartridge or a module vertically therein, whereby water is purified and cooled while passing from the inlet to be dispensed at the outlet. Prior art in thermoelectric fluid cooling, for example, U.S. Pat. Nos. 4,384,512 to Keith; 4,752,389 to Burrows; 4,913,318 to Forrester; 5,209,069 to Newman; 5,501,077 to Davis et al; and 5,544,489 to Moren describe the use of conventional thermoelectric cooling devices as affixed to the surface of a water container for the purpose of cooling water by natural convection within the container. U.S. Pat. No. 4,281,516 to Berthet et al describes a thermoelectric cooling device comprising a liquid flow circuit in the form of a bendable metal tube imbedded within the cold plate of a multi-plate thermoelectric cooler system. U.S. Pat. No. 5,494,195 to Knuettel et al describes a thermoelectrically cooled beverage dispenser comprising a liquid flow circuit in the form of a channel having affixed conventional thermoelectric devices.

None of the prior art devices depicts an in-line, fully integrated, single element fluid cooling system in the form of a detachable bottle-like coaxial cylindrical cartridge, having only one port for fluid inlet and outlet, and is easily mounted on or removed from a flowboard or a manifold without tools and without disturbing the piping, wiring or other parts of the apparatus.

It is therefore an object of the present invention to provide a fully functional single-element thermoelectric water cooling device in the form of a vertically mounted cylindrical cartridge, which is similar to those used for water filtration and purification.

It is another object of the present invention to provide a cooling cartridge that provides immediate, on-demand cold water without requiring a reservoir for storing cold water.

It is another object of the present invention to provide a water-cooling cartridge, which is easy to install or to replace without the need for any tools or equipment.

It is another object of the present invention to provide a water-cooling cartridge, which has a single end with a water inlet and a water outlet forming a single concentric port.

It is a further object of the present invention to provide a water-cooling cartridge that can be mounted on a flowboard so as to be included with various other elements for water treatment.

It is a further object of the present invention to provide one or more water-cooling cartridges that can be mounted on a flowboard for a stand-alone counter top water cooler.

It is still a further object of the present invention to provide one or more water-cooling cartridges that can be mounted on a linear flowboard in the form of a manifold.

It is another object of the present invention to provide a water-cooling cartridge whereby the water flows upwardly through an annulus of a chamber and leaves axially through the water outlet tube.

It is another object of the present invention to provide a water-cooling cartridge whereby the water flows upwardly through a single entry circumferential helix disposed on an internal compartment, forming a narrow annulus with the water pipe, for the purpose of enhancing flow velocity and subsequently heat transfer rate.

It is a further object of the present invention to provide a water-cooling cartridge whereby the water flow pipe has external flat surfaces preferably of equal size so as to form a square wall pipe having a square internal channel.

It is a further object of the present invention to provide a water-cooling cartridge whereby the water flow pipe is a rectangular block with external flat surfaces of equal sides so as to form a square wall pipe having drilled or cast therein a circular internal passageway.

It is a further object of the present invention to provide a water-cooling cartridge whereby the water flow pipe is a conventional cylindrical pipe having affixed blocks of external flat surfaces and internal contoured surfaces for mating the pipes.

It is another object of the present invention to provide a water-cooling cartridge that can include a multi-section finned heat sink affixed circumferentially around the water flow pipe in which the heat sink is separated from the external surface of the water flow pipe by an insulating material.

It is another object of the present invention to provide a water-cooling cartridge having a multi-section finned heat sink which is formed of an economical highly heat conductive material such as aluminum.

It is another object of the present invention to provide a water-cooling cartridge in which the finned member of the heat sink has extruded, machined or molded longitudinal fins of different lengths which extend along the length of the heat sink with each heat sink affixed to one side of the water flow pipe external wall so as to form a continuous circular heat exchanging surface.

It is still another object of the present invention to provide a water-cooling cartridge which employs one or more thermoelectric elements positioned between the surface of the water flow pipe and the heat sink so as to circumferentiary surround the water flow pipe.

It is another object of the present invention to provide a water-cooling cartridge which has the heat sink positioned within an external shell and provided with an integrated forced convection means, such as an electrically operated fan.

It is another object of the present invention to provide a water cooling cartridge whereby the fan is placed at the top of the cartridge so as to induce atmospheric air through an opening of the bottom of the shell in a coaxial flow pattern parallel to the hot sink finned members so as to cool the hot sink and to enhance heat transfer across the cartridge.

It is another object of the present invention to provide a water-cooling cartridge which has no exposed piping, piping connections or electrical wiring.

It is another object of the present invention to provide a water-cooling cartridge, which is temperature controlled with an integrated thermostat.

It is still a further object of the present invention to provide a water-cooling cartridge that can meet the infrequent or continuous variable demand of cold water by the use of a single cartridge having adequate diameter, height, internal heat transfer enhancing means such as a helix, and number of thermoelectric devices, or by a series of standard size water-cooling cartridges of the type described herein.

These and other objects and advantages of the present invention will become apparent from a reading of the attached specification and appended claims.

SUMMARY OF THE INVENTION

The present invention is an apparatus for cooling and dispensing fluids having a flowboard with a fluid passageway extending between an inlet and an outlet, and a water-cooling cartridge removably fixed to a mounting block or receptacle within the flowboard connected to the passageway. The water-cooling cartridge has a coaxial inlet and outlet for communicating with the fluid passageway of the flowboard. The water-cooling cartridge has: a square water flow pipe acting as a cold junction or cold plate and communicating with the inlet of the water-cooling cartridge; a finned heat sink positioned around the water flow pipe and separated therefrom with insulating material; a thermoelectric device acting as a heat pump securely positioned between the heat sink and the water flow pipe; a shell enclosing the heat sink defining a coaxial passageway for induced cooling air flow and forming an external housing for the water-cooling cartridge; a fin mounted at the top of the water-cooling cartridge so as to draw or induce air flow along the heat sink; and a thermostatic device for controlling water temperature above its freezing point.

The water outlet tube is axially placed in the water flow pipe and communicates with the outlet of the water-cooling cartridge. The interior wall of the water flow pipe for low capacity cooling defines an annulus with an exterior surface of the outlet axial tube and communicates with the inlet of the water-cooling cartridge. For high capacity water cooling, the interior of the water flow pipe is slightly tapered and houses a relatively large diameter cylindrical compartment, forming a narrow annulus with the water flow pipe. The compartment has a single inlet circumferential helical channel disposed on its external surface in close proximity to the water flow pipe so as to form a continuous single passageway for water flow.

The water flow pipe preferably has flat external surfaces defining a square internal channel or forming a cylindrical channel within a rectangular metal block. The water flow pipe acts as a cold junction or cold plate (cold side), where heat is absorbed from the fluid mostly by convection. It is preferable to maintain the cold plate temperature at about 35° F. (as determined by the design of the thermoelectric devices and process requirements). Lower temperatures should be avoided to prevent water freezing and subsequent blocking of water flow. Heat transfer between solids and liquids is relatively higher than between solids and air. Therefore, the heat sink (hot side), where heat is rejected, is normally large with multiple protrusions or fins to increase the exposed surface. However, in another embodiment of the water flow pipe, internal longitudinal fins or means to induce turbulence could be provided to enhance heat transfer through the liquid. A unique design of such heat transfer enhancement means is described hereafter. The thermoelectric devices are affixed to at least one of these external flat surfaces. The water flow pipe, with its flat external surfaces, is preferably made of high conductive metal hygienically acceptable for potable water service (such as copper or aluminum with an inert surface coating). The heat sink preferably has four sections, which are affixed circumferentiary to the fill length of the external wall of the water flow pipe. The cross section of each heat sink forms a segment of a circle having a flat base plate and equally spaced variable-length fins extending outwardly therefrom. Each plate mates with one side of the water pipe external wall and is secured thereto, preferably with non-heat conductive screws. The outer perimeter of the four mounted finned sections of the heat sink form a circular cross section that can be easily inserted in the cooling cartridge cylindrical shell to form a coaxial annulus for airflow. Means to position the cooling cartridge in its shell and prevent air by-pass are also provided.

An insulating material is affixed between the external flat surfaces of the water flow pipe and a base plate of the heat sink. The insulating material extends around the perimeter of the thermoelectric devices.

The airflow is enhanced by a fan which is mounted at the top of the water flow pipe and within the shell The shell and the water flow pipe define an air passing annulus. The fan is placed so as to draw or induce air upwardly through the air passing annulus.

In the present invention, a housing is detachably mounted onto the flowboard and over the water-cooling cartridge. A spigot is in fluid communication with the outlet of the flowboard and extends outwardly of the housing. Preferably a water filter is in fluid communication with the fluid passageway of the flowboard by a receptacle of the same type used for the subject water cooling cartridge. An electrically operated single ended solenoid valve means is also mounted on the flowboard for controlling fluid flow through the fluid passageway. The valve means is controlled by a fluid dispensing push button (switch) accessibly exposed on an exterior surface of the housing.

A non-intrusive surface thermostat is securely placed directly on the flat conductive top of the water flow pipe to provide an indicative measure of the water temperature within the water flow pipe. The location of the thermostat at the top of the water flow pipe is selected because upwardly flowing cooled water reaches it minimum temperature at this point. The thermostat disconnects power to the thermoelectric devices if surface temperature of the water flow pipe drops below a set point, preferably 35° F., to avoid water freezing in the pipe.

BRIEF DESCRIPTION OF THE DRAWINGS

The present invention will now be described, by way of example, with reference to the accompanying drawings, in which.

DETAILED DESCRIPTION OF THE INVENTION

Figure 1:
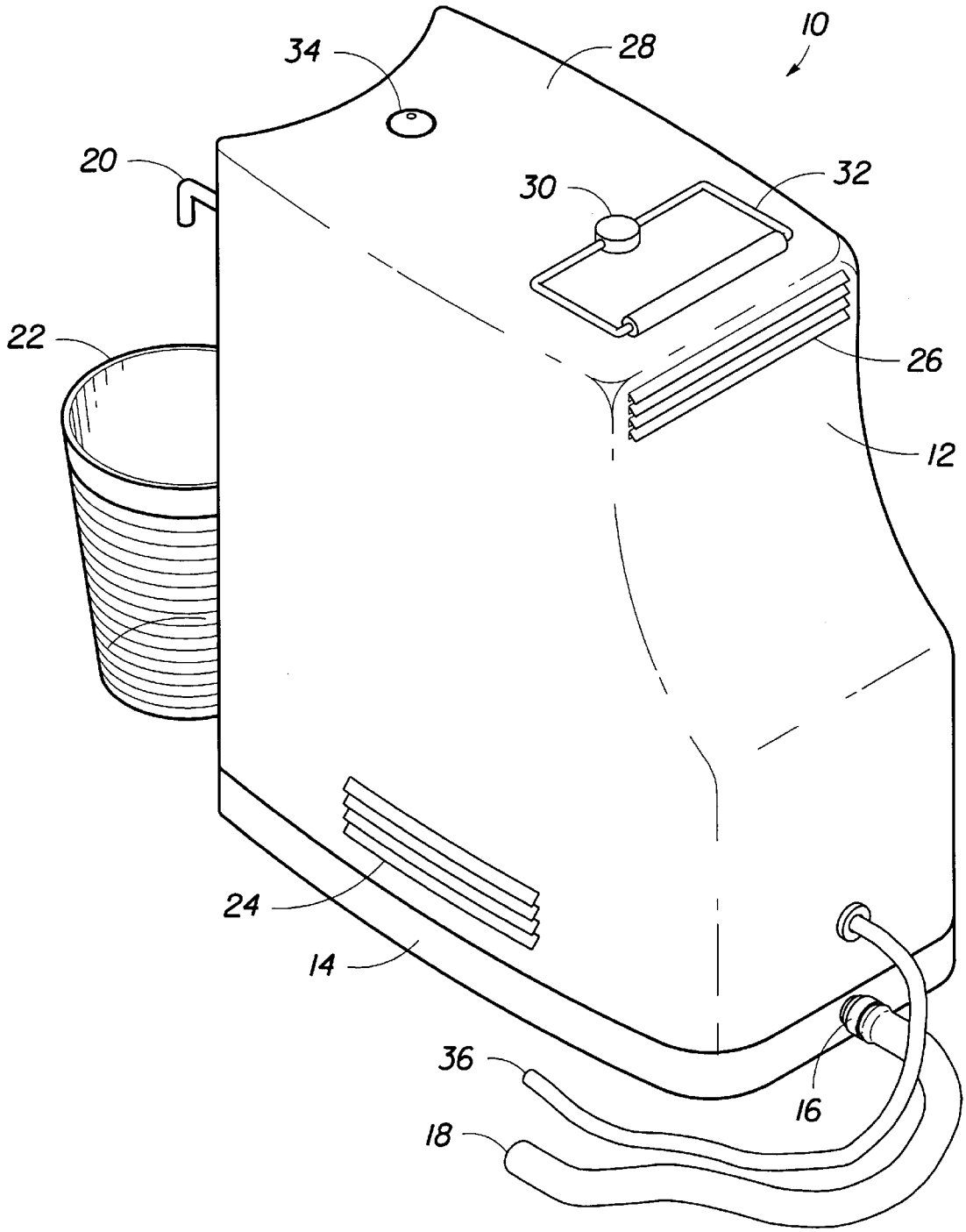
FIG. 1 is a perspective view of the present invention with the housing in place.

A water cooling and dispensing apparatus 10 in accordance with the teachings of the present invention is shown in FIG. 1. The apparatus 10 includes a detachable housing 12 affixed onto and over a flowboard 14. The flowboard 14 is of a type described previously mentioned U.S. Pat. Nos. 6,080,313 and 6,099,735 to the present inventor, the disclosures of which are incorporated herein by reference. The flowboard provides a circuitous pathway for water to travel from an inlet 16 to an outlet 46 (see FIGS. 2 and 3). A water supply tube 18 is connected to the inlet 16 so as to allow potable water to enter the flowboard 14. The tube 18 can be connected to any water supply suitable for delivering potable water. The outlet 46 of the flowboard 14 is connected to a spigot 20 extending outwardly from one end of the housing 12. The spigot 20 is illustrated as in a suitable position for dispensing filtered and cooled water into a glass 22.

The housing 12 includes a cool air intake vent 24 and a hot air outlet vent 26. The cooling air intake vent 24 is positioned near the bottom of the housing 12 adjacent the top of the flowboard 14. The hot air outlet vent 26 is positioned adjacent the rear end of the top surface 28 of the housing 12. A housing locking mechanism 30 is mounted on the top 28 of the housing 12. A handle 32 is pivotally received by the mechanism 30 so as to be movable between an upright position and a position lying against the top surface 28 of the housing 12. A water dispensing push button (electrical switch) 34 is mounted on the top surface 28 near the front end of the housing 12. Depressing button 34 activates the system solenoid valve 42 (to be described hereinafter) allowing water to enter the flowboard 14 and be released from the spigot 20. A power supply cord 36 extends from the housing 12 so as to be connected to the electrical apparatus within the housing 12 to a source of electrical power.

Figure 2:
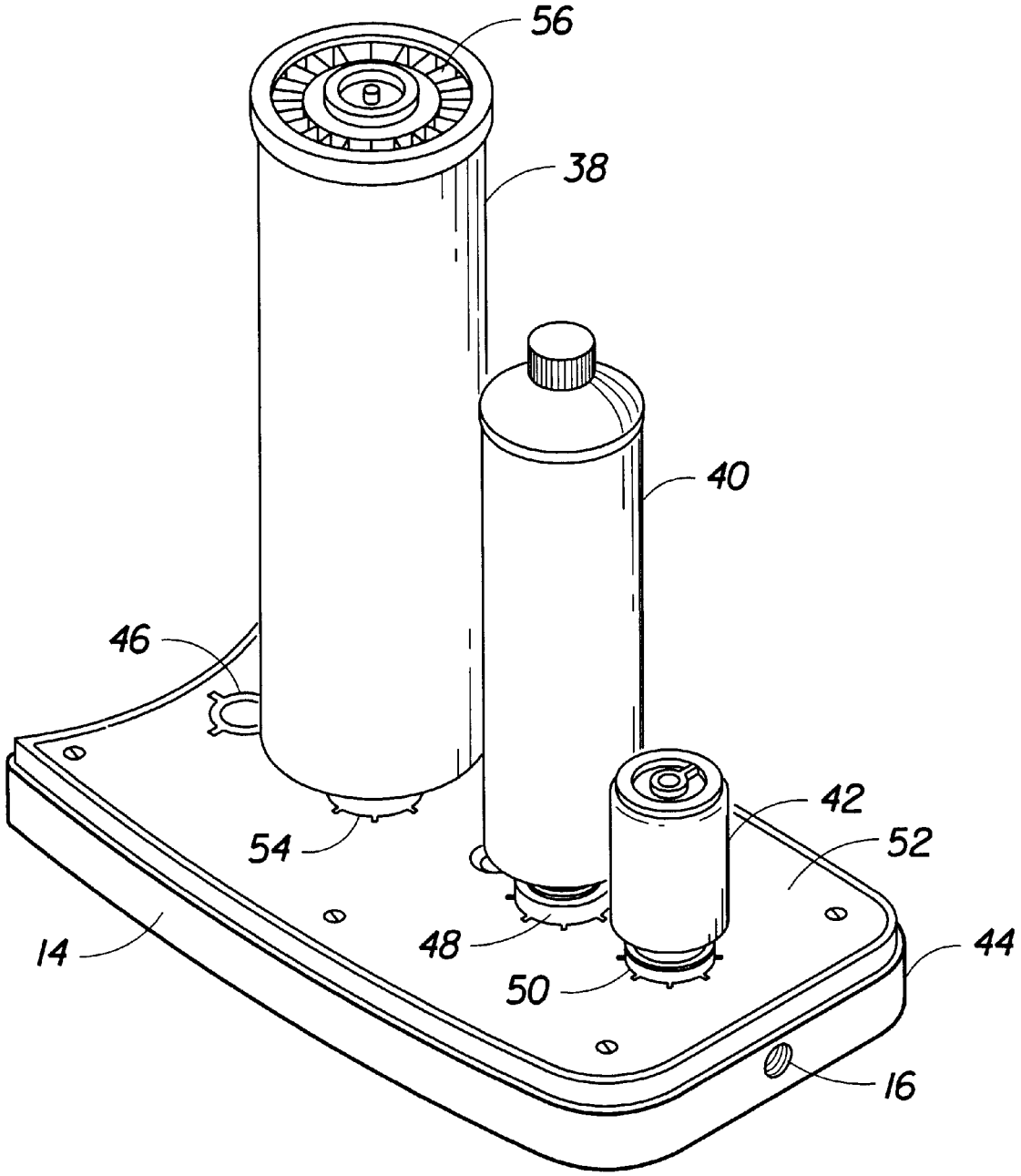
FIG. 2 is a perspective view, similar to FIG. 1, showing the present invention with the housing removed.

FIG. 2 shows present invention with the housing 12 removed revealing the flowboard 14, a water cooling cartridge 38, a water filter 40 and a solenoid valve 42. The water cooling cartridge 38, the water filter 40 and the solenoid valve 42 are single-ended and are mounted onto the flowboard 14 without any exposed piping or wiring. The housing 12 can be fitted onto the flowboard 14 by abutting with the shoulder 44 extending around the perimeter of the flowboard 14.

The flowboard 14 has water inlet port 16 at one end and water outlet port 46 at the opposite end. The water outlet port 46 can be connected to the spigot 20 so as to allow the cooled water to pass therefrom.

The water-cooling cartridge 38 has a cylindrical configuration and is received in a receptacle 54 on the flowboard 14. Similarly, the water filter 40 has a cylindrical configuration and is received in a receptacle 48 on the flowboard 14 and the solenoid valve 42 is received in a receptacle 50. The water-cooling cartridge 38 is spaced from the top surface 52 of the flowboard 14 forming an open area 86 (see FIG. 3) allowing cooling air to enter the air passing annulus 56 on the interior of the water-cooling cartridge 38. The receptacles 48, 50, and 54 are of a similar design to that described in previously mentioned U.S. Pat. Nos. 6,080,313 and 6,099,735.

Figure 3:
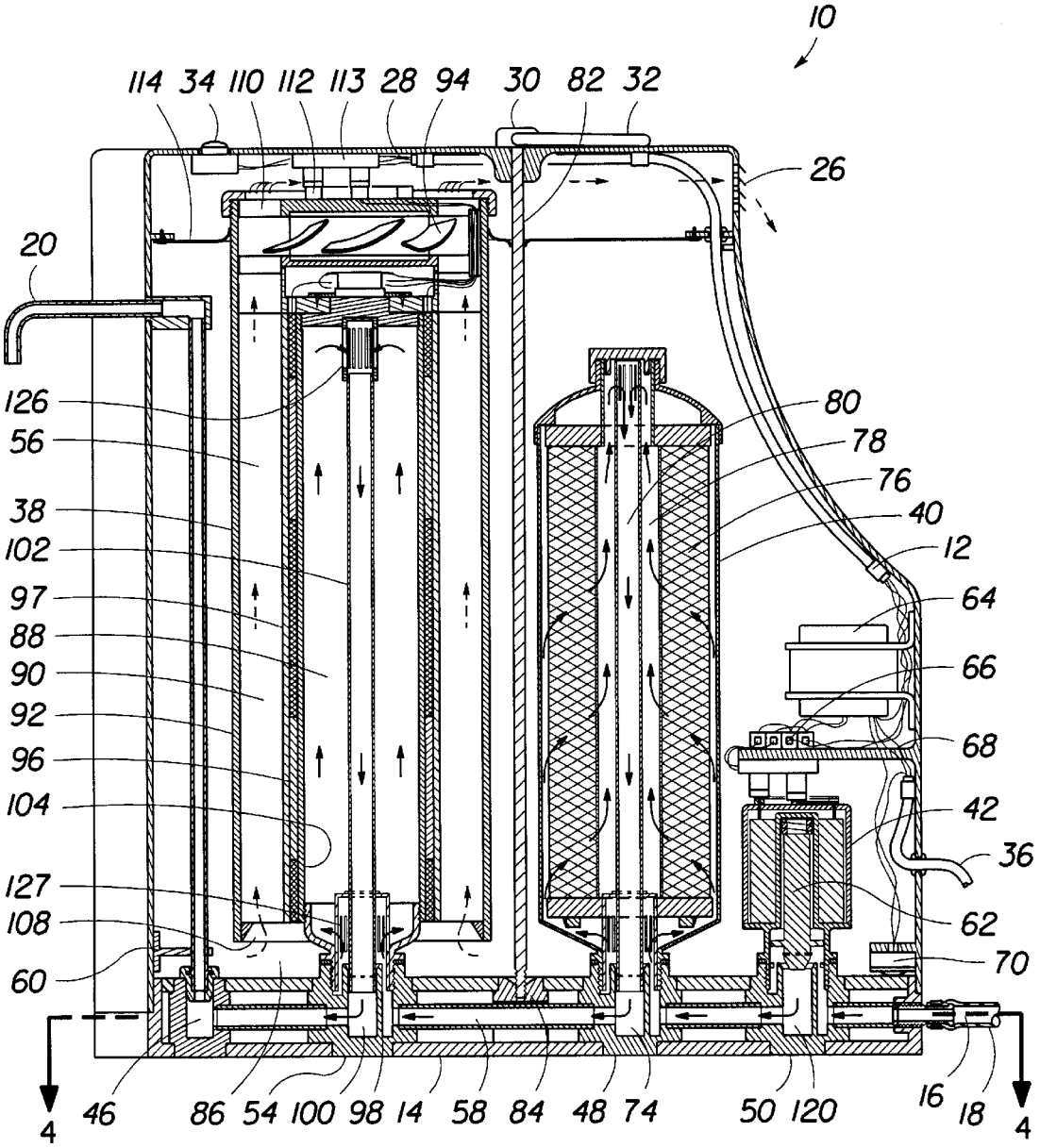
FIG. 3 is a vertical section through the present invention.

FIG. 3 shows that the flowboard 14 has an inlet 16 connected to a water supply (not shown) by a liquid tube 18 and the outlet 46 connected to spigot 20. A fluid passageway 58 extends through the flowboard 14 between the inlet 16 and the outlet 46. A spigot support member 60 is affixed onto an interior wall of the housing 12 so as to support the spigot 20 in its desired orientation.

As described in previously mentioned U.S. Pat. Nos. 6,080,313 and 6,099,735, the solenoid valve 42 is mounted in the receptacle 50 and has a plunger 62 that engages a valve seat disposed within the valve mounting block 50. The plunger 62 shuttles between a normally closed position preventing fluid flow through the passageway 58 and an opened position allowing fluid flow through the fluid passageway 58. The valve 42 is actuated by the dispensing push button 34, which is accessibly mounted on the top surface 28 of the housing 12, via an AC/DC transformer 64. The transformer 64 is electrically connected to terminal blocks 66 mounted on the support surface 68 within the housing 12. The power supply line 36 supplies AC power to the transformer 64. A housing closure switch 70 is positioned adjacent to the bottom of the housing 12 and is electrically connected to the transformer 64 and to the terminal block 66 so as to prevent the application of power to the various components until such time as the housing 12 is securely placed onto the flowboard 14. It should be noted that, in the present invention, virtually all of the electrical connections are located above the flowboard 14. Thus, if any flooding should occur due to leakage within the flowboard 14, the electrical system and components will be isolated from any water.

The water filter 40 is received in the receptacle 48 so as to communicate with the flow of fluid through passageway 58 in the flowboard 14. As seen in FIG. 3, the liquid from the fluid passageway 58 will enter the opening 74 at the bottom of the water filter 40, flow through the outer annulus of the filter 40, radially inwardly through the filter media 76 and into the inner annulus 78. Filtered water exits downwardly through axial pipe 80 to passageway 58 via the filter mounting receptacle 48. The operation of this filter 40 is similar to that described in previously mentioned U.S. Pat. No. 6,080,313.

In order to secure the housing 12 onto the flowboard 14, a locking mechanism 30 is mounted on the top surface 28 of the housing 12. A handle 32 is pivotally connected to the mechanism on the upper end of the housing locking rod 82 extends from the top surface 28 downwardly so as to be threadedly received by a support member 84 located in the flowboard 14. Rotation of the handle 32 will cause the rod 82 to rotate to engage with (or disengage from) the flowboard 14. The support member 84 is provided in the center of the flowboard 14 between the filter cartridge 40 and the water cooling cartridge 38 and provides the necessary strength to support the weight of the apparatus.

Figure 5:
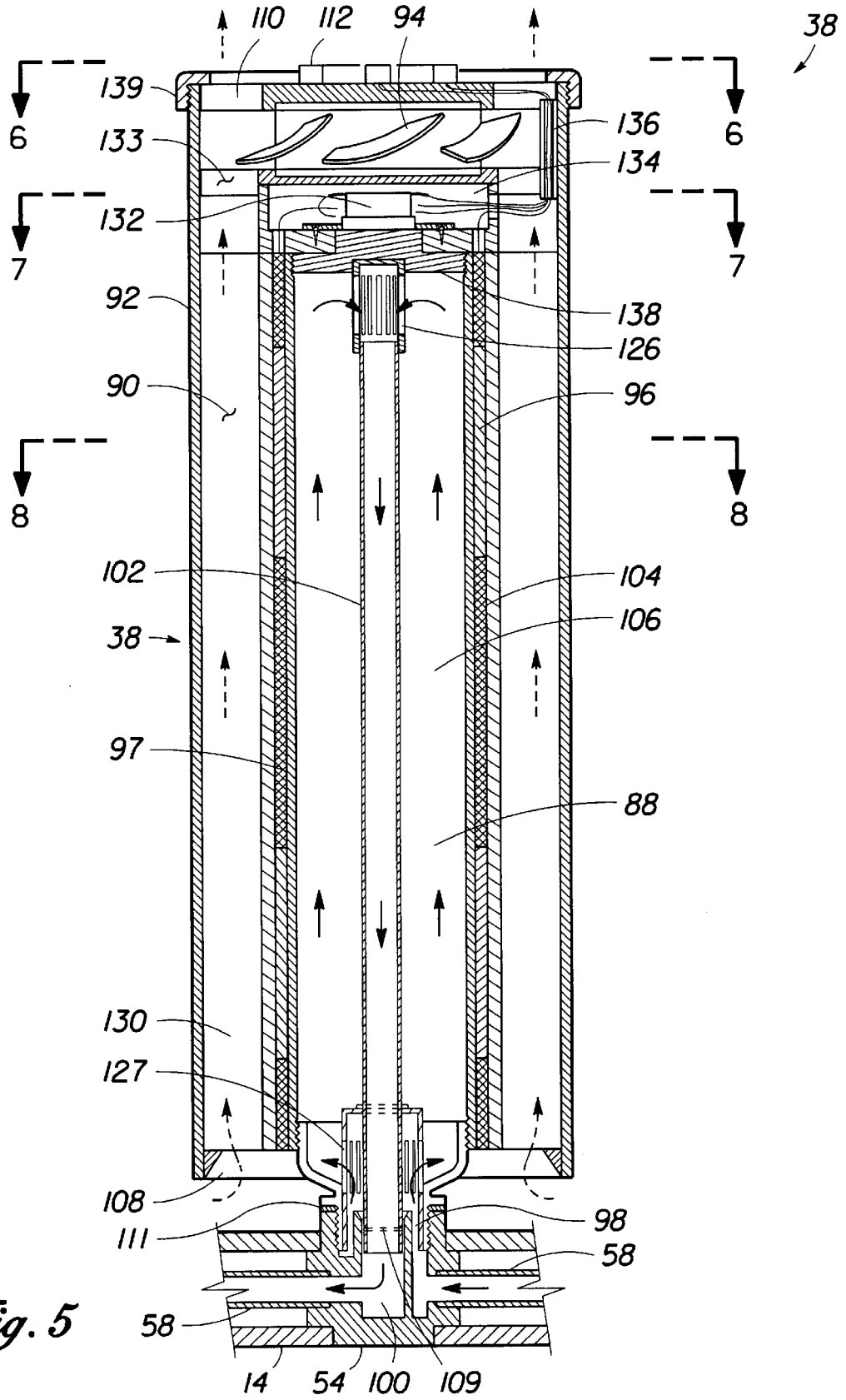
FIG. 5 is a vertical section, similar to FIG. 3, showing the water-cooling cartridge of the present invention in greater detail.

The primary feature of the present invention is the water-cooling cartridge 38, best seen in FIG. 5. The water-cooling cartridge 38 is received in a mounting block 54 fixed in the flowboard 14. The water-cooling cartridge includes a water flow pipe 88, a multi-section heat sink 90, a shell 92, an airflow inducing fan 94, thermoelectric devices 96, and temperature control thermostat 132. As can be seen, the water flow pipe 88 communicates with the inlet 98 of the water-cooling cartridge. The heat sink 90 is positioned around the water flow pipe 88. The shell 92 encloses the heat sink 90 and the water flow pipe 88. The airflow fan 94 is mounted at the top of the water-cooling cartridge 38 so as to draw air across the heat sink 90. The thermoelectric devices 96 are positioned between the heat sink 90 and the water flow pipe 88.

The water flow pipe 88 has an axial outlet water tube 102 which communicates with the outlet 100 of the water-cooling cartridge and is sealed with an O ring 109. The outlet tube 102 is removable and replaceable and retained in place at both ends by perforated chambers 126 and 127 to allow for water flow between the cartridge inlet and outlet. The interior wall 104 of the water flow pipe 88 defines an annulus 106 with an exterior surface of the tube 102. This annulus 106 communicates with the inlet 98 of the water-cooling cartridge 38. Both the inlet 98 and outlet 100 of the water-cooling cartridge 38 form a single ended concentric port.

The heat sink 90 is affixed circumferentially around the water flow pipe 88 for its full external surface. The blades of the fan 94 extend over the top of the air passing annulus 130 formed between the shell 92 and the heat sink 90. Air flow is induced by the fan 94 and enters the water-cooling cartridge 38 at the air inlet aperture 108 at the bottom of the shell 92, flows upwardly along the fins 162 of the heat sink 90, and exits through the air outlet port 110 at the top of the water-cooling cartridge. Hot air from port 110 exits the housing 12 at the hot air vent 26.

Figure 6:
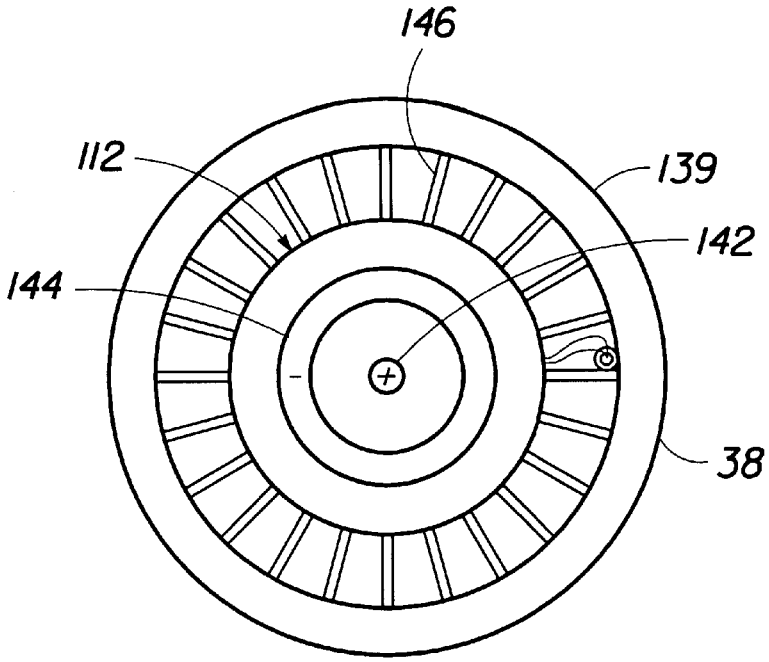
FIG. 6 is a top plan view taken along line 6—6 of FIG. 5.
Figure 11:
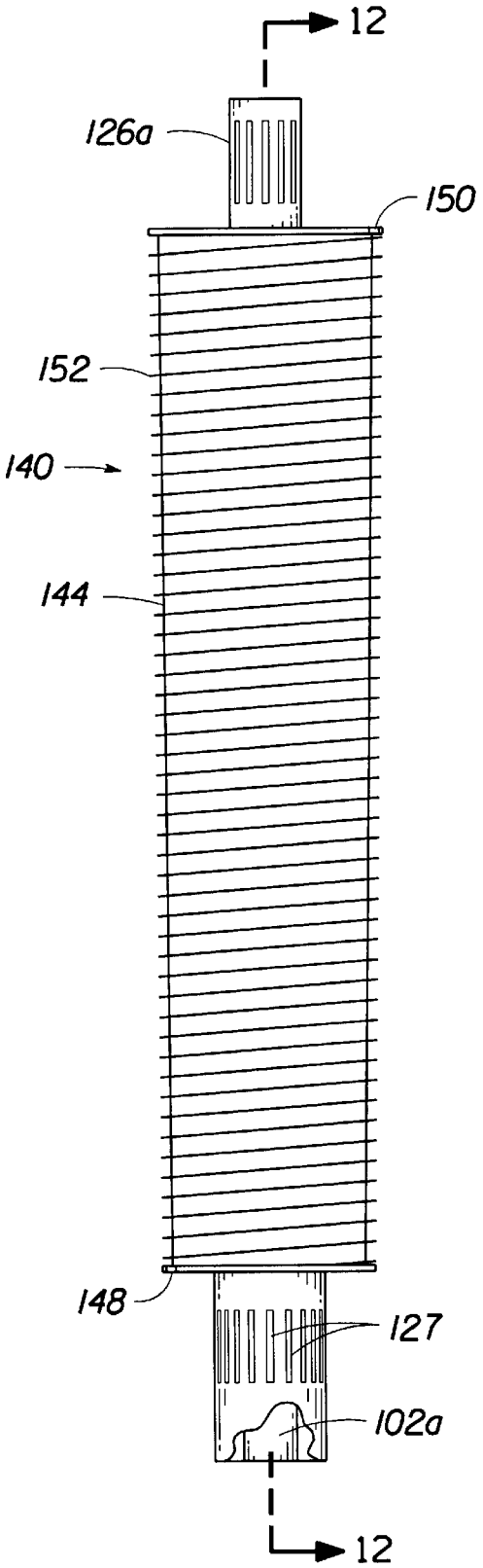
FIG. 11 is a side elevation of the heat transfer enhancer means for a high capacity water cooling cartridge in accordance with the present invention.

Power is provided to the water-cooling cartridge 38 via a circular terminal block 112 (see FIG. 6). The circular terminal block forms a disk with radially extended fins 146 for positioning the block on top of fan 94 and within the shell 92 of the water-cooling cartridge, as well as for allowing air movement within the annulus 106. The contact strips of the terminal block 112 engage corresponding power supply terminals 113 securely mounted to the inner surface of housing 12. Both the fan 94 and the thermoelectric devices 96 are preferably operated with a DC power supply as illustrated in FIG. 11. A flexable diaphragm 114 (FIG. 3) is positioned within the housing 12 so as to isolate intake air from venting air and to keep airflow in the desired direction.

Figure 4:
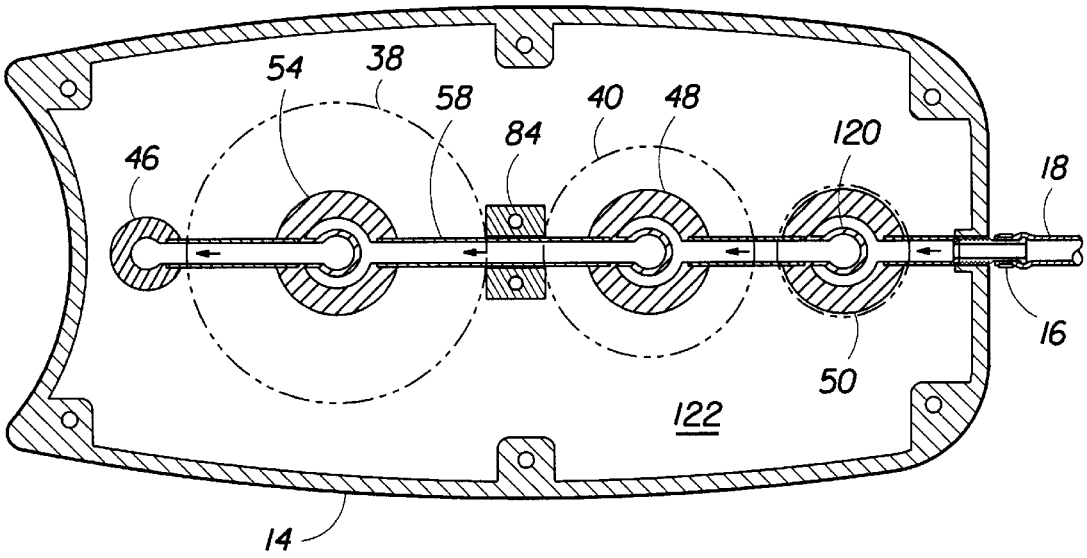
FIG. 4 is a horizontal section taken along line 4—4 of FIG. 3.

FIG. 4 illustrates the interior configuration of flowboard 14. For safety concerns, only fluids (water) will flow through the flowboard 14. All of the electrical components and power lines within the housing 12 are isolated from the flowboard 14.

Water will enter the flowboard 14 through the inlet 16 and will flow through the valve receptacle 50 to enter the axial chamber 120 responsive to the solenoid valve 42. Water will then flow through flow passageway 58 to the receptacle 48 for the filter cartridge 40. The fluid passageway 58 also extends from the filter cartridge 40 to the water-cooling cartridge 38 before exiting at the outlet 46.

Returning to the detailed view of the water-cooling cartridge 38 in FIG. 5, the water will be cooled as it contacts the cold sink formed by the inner wall 104 of the water flow pipe 88. The water will then flow axially downwardly through the interior of the outlet tube 102 (as illustrated by the arrows) through the outlet 104. Thereafter, water enters the fluid passageway 58 within the flowboard 14.

The inner wall 104 of the water flow pipe 88 should be of a highly heat conductive material, such as copper or aluminum This wall could be plated with a noble metal or coated with a thin layer of a suitable coating for handling potable water. In another embodiment (not shown), the wall 104 could have extended fins to increase the area of contact and enhance heat transfer. As such, the cooling effect caused by the thermoelectric element 96 can be rapidly imparted to the water as its flows through the annulus 106. An insulating material 97 is placed around the exterior surfaces of the water flow pipe 88, except for the area occupied by the thermoelectric devices 96, to completely isolate the cold plate from the heat sink.

The heat sink 90 is positioned adjacent to the wall 104 of the water flow pipe 88 such that the thermoelectric devices 96 are sandwiched between the heat sink 90 and the inner wall 104. The insulating material 97 will reside in those spaces between the heat sink 90 and the inner wall 104 of the water flow pipe 88 which were not occupied by the thermoelectric devices 96. The fins of the heat sink 90 will extend into the annulus 130. The design and configuration of the heat sink is determined by process requirements and ability to remove heat generated by the thermoelectric devices. The annulus 130 passes the air from the air inlet 108 through the outlet 110. The flow of air through the annulus 130 is created by the inducing action of the fan 94 located at the top of the water flow pipe 88. A surface sensing thermostat 132 is positioned at the top of the water flow pipe 88, where water temperature reaches its minimum, so as to sense the temperature of a copper block 138 in direct contact with the water inside the water flow pipe 88. Conventionally, the thermostat should be set at between 35° to 40° F. The thermostat 132 includes electrical connections extending outwardly from the cavity 134. The wiring bundle 136 extends outwardly of the water cooling cartridge 38 through a slot located at the top of the cartridge 38. Terminal block 112 is provided at the top of the cartridge 38.

FIG. 6 is a top plan view taken along line 6—6 of FIG. 5. A cartridge locking threaded flange 139 engages the top of the cartridge 38 so as to securely retain the fan 94 and the other elements in place within the interior of the cartridge 38. The circular terminal block 112 forms a disk with radially extended fins 146 for positioning the block on top of fan 94 within the shell 92 of the water cooling cartridge, as well as for allowing air movement through the cartridge annulus. The circular terminal block 112 comprises a positive contact strip 142 located at the center of the terminal block, while a negative contact strip 144 will extend around the terminal block 112.

Figure 7:
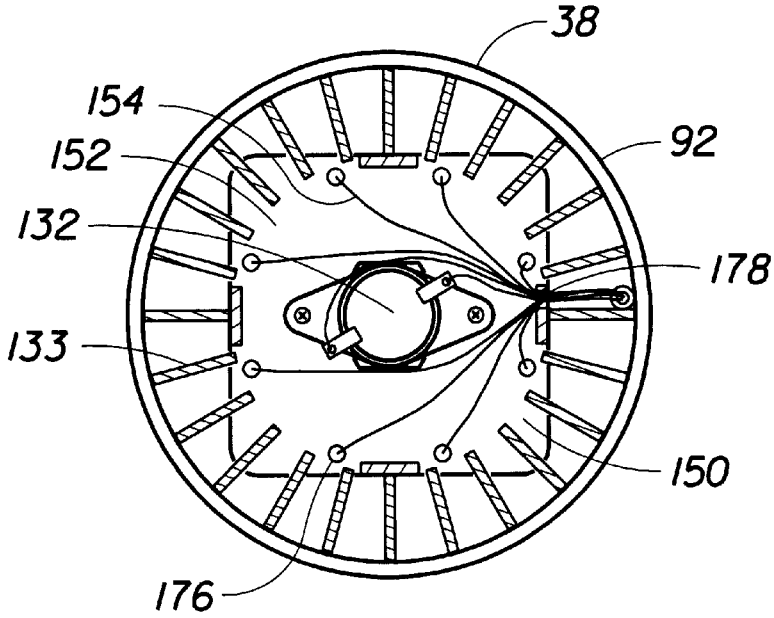
FIG. 7 is a horizontal section taken along line 7—7 of FIG. 5.

FIG. 7 is a transverse section taken along line 7—7 of FIG. 5 showing the thermostat compartment 150. The thermostat 132 is affixed onto a panel 152, preferably of thermally neutral material, such as plastic, residing above the water flow pipe 88. Wires 154 extend through holes 176 formed in the panel 152 and are connected to the thermoelectric devices mounted on the wall of the water flow pipe 88. A system wiring harness 154 is positioned adjacent to the wall of the shell 92 so as to allow the bundle of wires to be extended through the interior of the housing 12. The thermostat 132 is, in the preferred embodiment of the present invention, an AIRPAX (TM) series 5005 thermostat. This is a thermostat specifically designed for switching DC power. A construction of the thermoelectric assembly offers excellent mechanical shock and vibration resistance. The thermal response is rapid due to its low mass.

Figure 8:
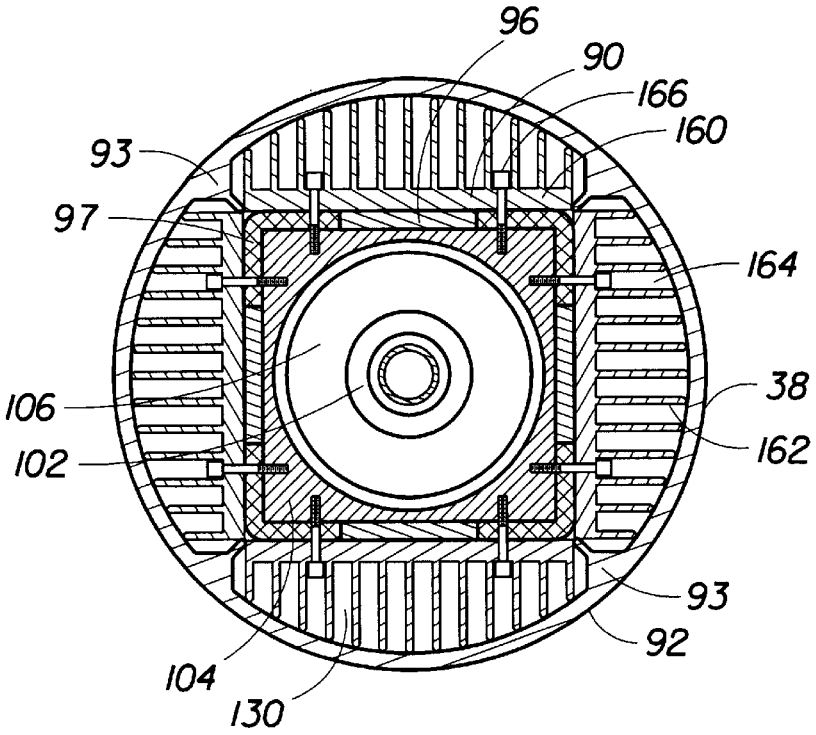
FIG. 8 is a horizontal section taken along line 8—8 of FIG. 5.

FIG. 8 is a transverse section taken along line 8—8 of FIG. 5. It can be seen that a tubular shell 92 extends around the various components of the water-cooling cartridge 38. The heat sink 90 includes a flat base 160 from which fins 162 extend outwardly. The fins 162 extend from the flat base 160 associated with each of the heat sinks 90 so as to have an outer end, which resides in very close proximity to the inner wall 164 of the shell 92. The shell has four equally spaced radial members 93 to position the assembly of the water pipe 88 and its surrounding heat sinks 90 in a non-rotating axial alignment. Meanwhile, the members engage the space between the adjacent heat sinks and restrict air by-pass through those vacant areas. Each of the fins 162 has a length which is different than the length of each adjacent fin. The heat sinks 90 are preferably formed by molding or extrusion from an economical heat conductive material, such as aluminum. The fins 162 will extend through the air-passing annulus 130 to provide greater convection and heat transfer between the air passing therethrough and the surfaces of the heat conductive material of the heat sinks 90. Each of the heat sinks 90 has its flat base 160 secured by non-conductive screws 166 to the wall 104 of the water flow pipe 88. The wall 104 is shown as having flat exterior surfaces suitable to accommodate conventional flat surface thermoelectric devices 96. Insulating material 97 is positioned between the flat surfaces 160 of the heat sinks 90 and the exterior surface of the wall 104 of the water flow pipe 88. FIG. 8 also shows the water flow annulus 106 and the outlet tube 102.

Figure 9:
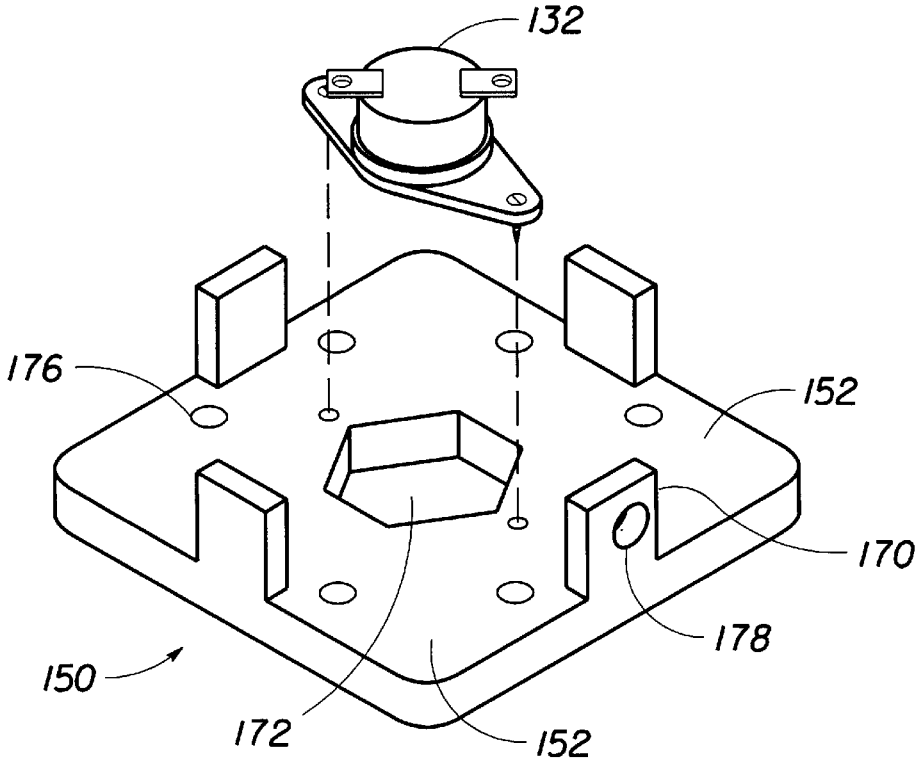
FIG. 9 is a perspective view of the thermostat compartment and terminal block below the fan associated with the present invention.

FIG. 9 is a perspective view of the panel 152 for supporting the thermostat 132. Height control flanges 170 extend upwardly from the flat top surface of panel 152. A central aperture 172 is cut in the panel 152 to match the end block 138 of the water chamber associated with the water flow pipe 88. This end block of the water chamber is preferably designed as a hexagonal nut to be used for securing the top of the water flow pipe and also to provide an elevated base for the surface-sensing thermostat 132. Various holes 176 are formed in the plate 152 so as to allow the various wires to extend to the thermoelectric elements. A wiring bundle hole 178 is formed in one height control flange 170 to allow the wiring bundle to extend outwardly therethrough.

Figure 10:
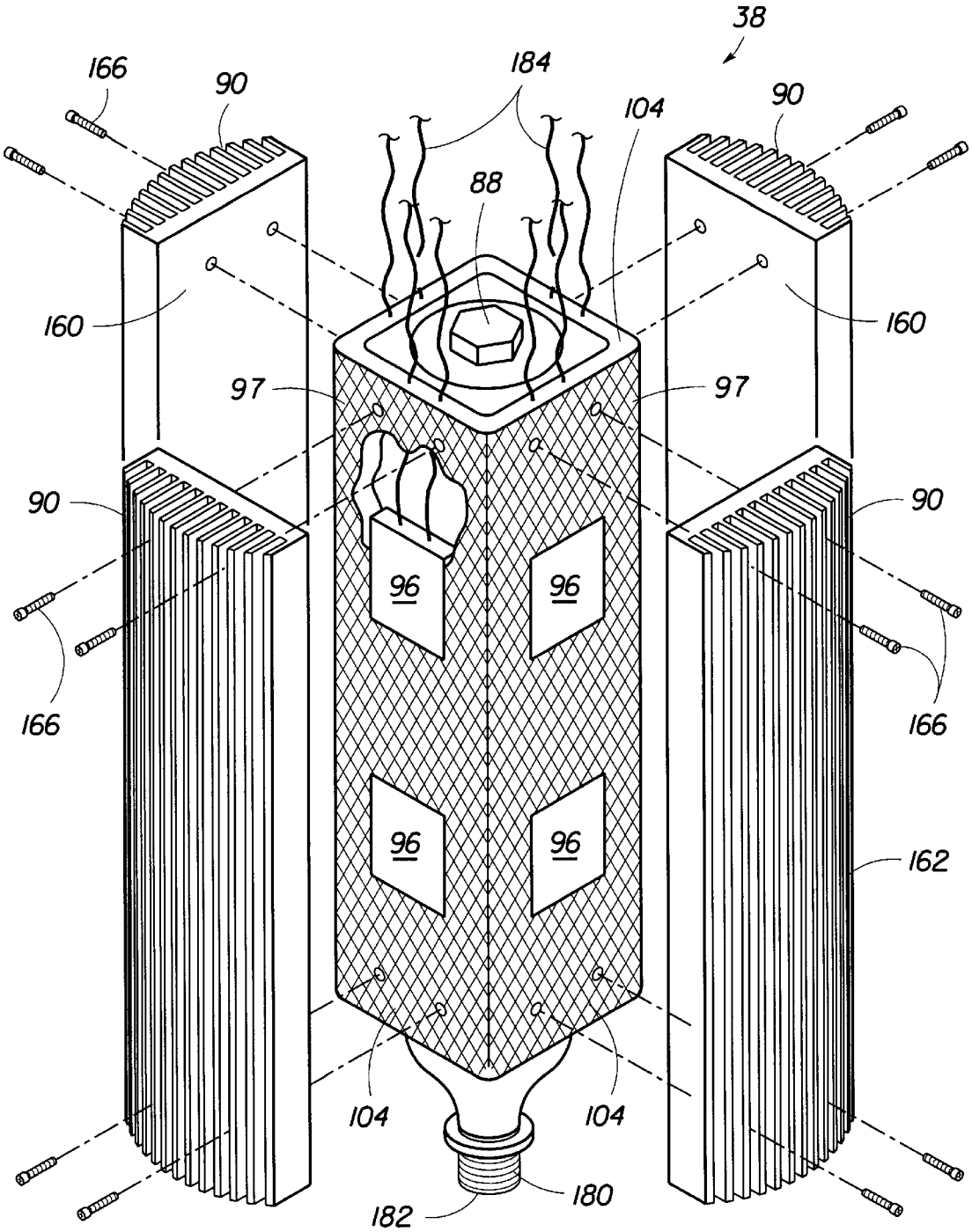
FIG. 10 is an exploded perspective view of the water-cooling cartridge of the present invention with the shell removed.

FIG. 10 is an exploded view of the water-cooling cartridge 38 of the present invention with the shell 92 removed. The water flow pipe 88 is shown, for convenience, with a square external cross section with flat surfaces and acts as a cold junction or cold plate. It will be appreciated that any number of flat surfaces can be used for the water flow pipe. A like number of finned heat sinks 90 are positioned around the water flow pipe and are separated therefrom by insulating material 97. One or more thermoelectric devices 96, acting as a heat pump, are also positioned between the heat sink and the water flow pipe and secured thereto. The outlet and inlet of the water flow pipe form a single ended concentric port 182 which is externally threaded 180 for engaging the threaded mounting block 54. When the heat sinks 90 are secured to the water flow pipe 88, the heat sinks 90 will act as "hot plate" while the walls 104 of the water flow pipe 88 will act as "cold plate." The size, number, and design criterion of the thermoelectric devices 96 will depend upon the desired capacity of the water-cooling apparatus 10.

The thermoelectric devices 96 preferably include an array of bismuth telluride semiconductor pellets that have been doped positive or negative. The pairs of positive/negative pellets are connected electrically in series and thermally in parallel. A metalized ceramic substrate material provides the platform for the pellets and the small conductive tabs that connect them. When DC voltage is applied to the module, via wiring connection 184, the semiconductor material absorbs heat energy on one substrate surface and releases it on the opposite surface. The surface where heat energy is absorbed becomes cold. The opposite surface, where heat energy is released, becomes hot. The thermoelectric devices 96, as employed in the preferred embodiment of the present invention, are manufactured by Melcor Thermoelectrics of Trenton, N.J.

Figure 12:
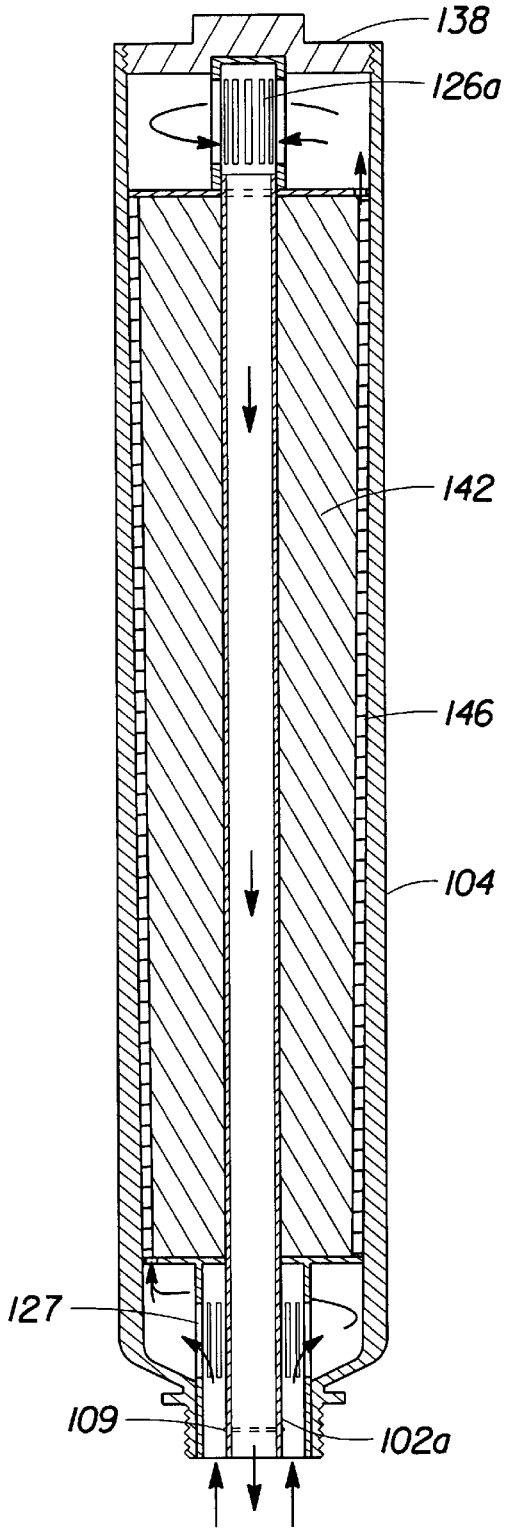
FIG. 12 is a vertical section taken along line 12—12 of FIG. 11 as placed in the water flow pipe of the present invention.

FIGS. 11 and 12 are external and vertical section views, respectively, of the heat transfer enhancer means for a high capacity water-cooling cartridge in accordance with the present invention. The simple design of the annulus flow of the subject cooler, as described earlier and shown in FIG. 5, has a heat load of about 600–750 BTU per hour and is capable of producing 40° F. cold water at a rate of about three gallons per hour. For a conventional water pipe of 1.5 inches in diameter, as depicted in FIG. 5, the upward flow has a Reynolds number of less than 100 and it is stipulated that the flow is laminar and that the heat transfer across the water pipe takes place by forced convection in an annulus.

Increasing the flow rate through the annulus tends to increase the heat transfer rate as a result of enhancing the heat transfer film coefficient at the boundary layer of the water pipe wall. However, the enhancement in heat transfer is not necessarily proportional to the increase in flow rate. As a result, the exchanger performance tends to worsen as the flow increases and eventually the cooler fails to meet its outlet design temperature. Any significant increase in the thermal performance of the cooler, for example, by increasing its performance 2–4 fold, cannot be simply achieved by just increasing flow through the unit. In such case, other means to enhance heat transfer across the surface of the water pipe is required, providing heat can be also transmitted from the wall of the water flow pipe to its surroundings.

Therefore, it is an important object of the subject invention to provide a heat transfer enhancing means that increases heat transfer rate by about three fold and subsequently the capacity of the water cooler using essentially the same water pipe design as shown in FIG. 5.

In the enhanced capacity water cooler, the axial water flow outlet tube 102 is designated 102*a* (FIGS. 11 and 12) to allow for an enlarged sleeve of plastic material 140, forming a coaxial compartment around the axial water outlet tube 102*a* and acts as a small reservoir 142 for cooled water. A helical channel 144 of small rectangular of hemispherical cross section is formed by molding, extruding or pinning the external surface of the coaxial compartment. The channel engages the annulus space between the coaxial compartment 140 and the internal wall of the water pipe 104 and forms a single closed helical passageway duct 146 against the internal water pipe wall, having only one inlet water port 148 and one outlet water port 150. In such embodiment, water travels in a duct that is much smaller than the original annular passageway, maintaining direct contact with the water pipe wall, for a relatively long path, at a velocity off 10–20 fold the annulus flow of the original embodiment. A slight tapering of the water pipe makes placement of the helical coil 144 easier and sealing of the helix-protruded edges 152 against the internal wall of the water pipe more effective. It is also possible that the helical channel can be formed as a self-supported, spring-like member, acting as a stint within the water pipe, without the support of the coaxial compartment (not shown).

Figure 13:
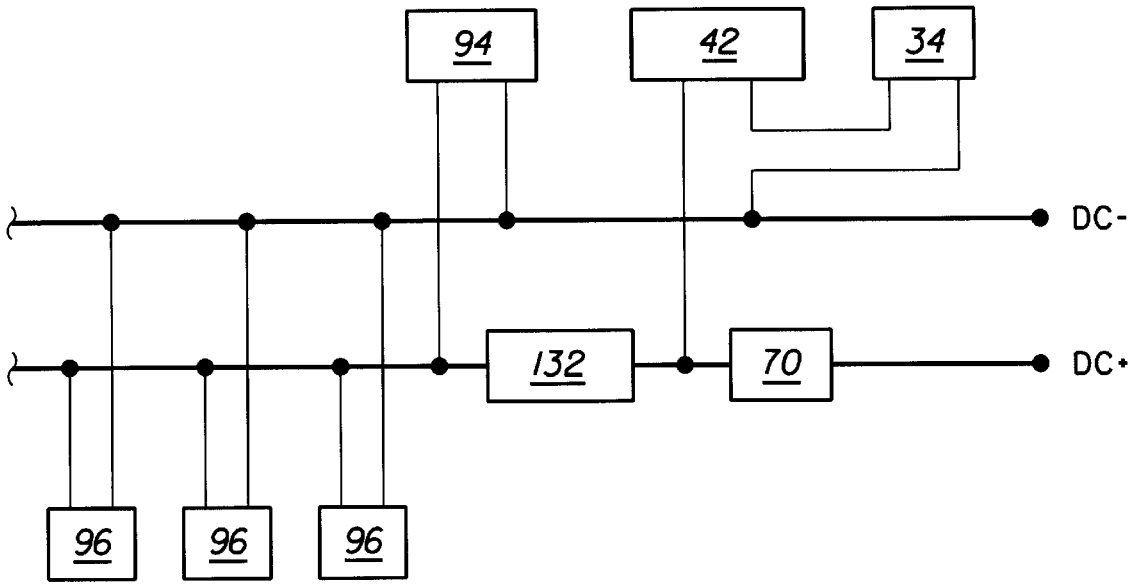
FIG. 13 is an electrical schematic, on block level, of the present invention.

FIG. 13 is an electrical schematic for the present invention. The wiring is extended to housing closure switch 70, solenoid valve 42 , its actuator push button 34, fan 94, thermostat 132 and multiple parallel runs to thermoelectric elements 96. A primary objective of the electrical system is that the system will not be energized unless the system housing 12 is safely secured and locked in place on the flowboard 14, the fan and the thermoelectric elements are switched off when the thermostat reaches the set point temperature. Water can be withdrawn when the solenoid valve is actuated, regardless of water temperature. Other features for monitoring and alarm systems are not shown for the sake of simplification of the present drawings.

It is believed that the present invention is the first thermoelectric cooling apparatus in the form of a coaxial cylinder that can be used for the cooling of fluids. It is also believed that the present invention is the first thermoelectric cooling apparatus in the form of a single-ended fully encapsulated fluid-cooling cartridge.

The foregoing disclosure and description of the invention are illustrative and explanatory thereof. Various changes in the details of the illustrated construction may be made without departing from the true spirit of the invention as defined by the appended claims.

Technical References

1. C. Y. Chen, G. A. Hawkins, and H. L. Solberg, Tran. ASME 69,99 (1940)
2. M. Jakob, Heat Transfer, Vol I, Page 551, Wilet, N.Y. (1949)
3. W. H. McAdams, Heat Transmission, 3$^{rd}$ Edition, McGraw Hill, N.Y. (1954)
4. Perry's Chemical Engineering Handbook, 6$^{th}$ Edition, Pages 10–17

I claim:

1. A counter top mounted apparatus for cooling and dispensing fluids comprising:

flowboard mounting base having an inlet, an outlet, and a fluid passageway extending between said inlet and said outlet, a plurality of receptacles on said flowboard each connected to said fluid passage and adapted for accepting single ended cartridges therein;

thermoelectric fluid cooling cartridge means receivable on said flowboard, said cooling cartridge means having a single port for an inlet and an outlet communicating with said passageway of said flowboard, a vertically mounted coaxial water flow pipe communicating with said inlet of said water cooling cartridge, said water flow pipe having a cylindrical interior with plurality of flat external surfaces, a like plurality of longitudinally finned heat sink means positioned coaxially around said water flow pipe, forced air fan means connected to said fluid cooling cartridge so as to draw air flow across said heat sink, and solid state thermoelectric heat pump means formed by arrays of P and N pellets of semiconductor material, said pellets being connected electrically in series and thermally in parallel and encapsulated between metalized ceramic substrates, said arrays being positioned between said heat sinks and said water flow pipe; and a cartridge external shell extending around and fully encapsulating said heat sinks and said water flow pipe and providing an annulus for air driven be said air fan.

2. The apparatus according to claim 1 wherein said outlet of said water cooling cartridge is concentric within said inlet of said water cooling cartridge at one end of said water cooling cartridge.

3. The apparatus according to claim 2 wherein said water flow pipe has a tube with the interior of said tube communicating with said outlet of said water cooling cartridge, said water flow pipe having an interior wall defining an annulus with an exterior surface of said tube, said annulus communicating with said inlet of said water cooling cartridge.

4. The apparatus according to claim 2 wherein said water flow pipe has a heat transfer enhancing means forming a coaxial compartment to an axial tube interior thereof said tube communicating with said outlet of said water cooling cartridge, said coaxial compartment having an exterior helical channel of rectangular or hemispherical small cross section, said helical channel engaging an annulus between the coaxial compartment to the axial tube and the interior surface to the water flow pipe forming a single close helical passageway duct of large length and small cross section, proving high flow velocity therein and enhancing heat transfer coefficient, said inlet of the helical passageway communicating with said inlet of said water cooling cartridge and said outlet of the helical passageway communicating with the axial water tube.

5. The apparatus according to claim 4 wherein said water flow pipe has a heat transfer enhancing means forming a helical channel of rectangular or hemispherical small cross section, said helical channel is a self-supported, spring-like member acting as a stint within the water pipe, said helical channel forming a single closed helical passageway duct of a large length and small cross section providing high flow velocity therein and enhancing the heat transfer coefficient, said inlet of the helical passageway communicating directly with said inlet of said water cooling cartridge and said outlet o the helical passageway communicating directly with the axial water tube.

6. The apparatus according to claim 1 wherein said water flow pipe has a plurality of flat external surfaces defining a regular geometric cross section, said thermoelectric cooler affixed to at least one of said flat surfaces.

7. The apparatus according to claim 6 wherein at least said external flat surfaces of said water flow pipe are of a copper or aluminum material.

8. The apparatus according to claim 7 wherein said copper and aluminum material for the interior surface of said water flow pipe is plated with a noble metal or layered with an inert coating suitable for potable water.

9. The apparatus according to claim 7 wherein said heat sink comprises four sections affixed circumferentially around the fill length of an external wall of said water flow pipe.

10. The apparatus according to claim 1 wherein each said heat sink forms a segment of a circle having a flat base plate and a plurality of equally spaced fins extending outwardly therefrom, each said fin having a length different form the adjacent fin so that the outer edge of the fins of said heat sink form a circular cross-section.

11. The apparatus according to claim 10 wherein said base plate mates with one side of an external wall of said water pipe and is secured thereon.

12. The apparatus according to claim 11 wherein said heat sink is inserted into and secured within a cylindrical shell to form a coaxial annulus for airflow.

13. The apparatus according to claim 11 wherein said shell has a circular configuration and is formed of a thin wall pipe or sleeve.

14. The apparatus according to claim 12 wherein said water-cooling cartridge further comprises:

insulating material affixed between said external flat surfaces of said water flow pipe and the base plate of said heat sink, said insulating material extending around said thermoelectric element.

15. The apparatus according to claim 7 wherein said thermoelectric elements comprise a plurality of thermoelectric elements affixed to said external flat surfaces.

16. The apparatus according to claim 10 wherein at least said fins are formed of an aluminum material.

17. The apparatus according to claim 1 wherein said air fan means is axially mounted and affixed at the top of said water flow pipe and within said shell, said water flow pipe and said shell defining an air passing annulus, said air fan means drawing air upwardly through said air passing annulus.

18. The apparatus according to claim 1 wherein said housing is detachably mounted onto said flowboard to substantially enclose said water-cooling cartridge.

19. The apparatus according to claim 1 further comprising:

a spigot in fluid communication with said outlet of said flowboard and extending outwardly of said housing.

20. The apparatus according to claim 1 further comprising:

water filtering means in fluid communication with said fluid passageway of said flowboard;

said water filter extending upwardly vertically from said flowboard; and valve means connected to said flowboard and having a valve element interactive with said fluid passageway of said flowboard, said valve means selectively moving said valve element from a first position allowing fluid flow through said fluid passageway and a second position preventing fluid flow through said fluid passageway of said flowboard.

21. The apparatus according to claim 20 wherein said valve means is a solenoid valve electrically interconnected with a fluid dispensing button, said button being accessibly placed on an exterior surface of said housing, said button being depressible so as to cause said valve element to move from said second position to said first position.

22. The apparatus according to claim 1 further comprising:

surface sensitive thermostat means affixed atop of said water flow pipe for maintaining water temperature above its freezing point by switching power to the heat pump means;

housing means received on said flowboard concealing said fluid cooling cartridge and having structure support means for all electrical wiring and components isolated form the water in said flowboard; and power interlock means on said housing means and flowboard allowing power actuation only when said housing means is secured to said flowboard.

* * * * *